US005842459A

United States Patent [19]

Akagi et al.

[11] Patent Number: 5,842,459

[45] Date of Patent: Dec. 1, 1998

[54] METHOD OF CONTROLLING FUEL INJECTION APPARATUS FOR INTERNAL COMBUSTION ENGINES

[75] Inventors: Jiro Akagi, Oyama; Hiroki Sato, Kawachi-gun; Koichi Okaya; Norifumi Abe, both of Oyama, all of Japan

[73] Assignee: Komatsu Ltd., Tokyo, Japan

[21] Appl. No.: 945,463

[22] PCT Filed: May 23, 1996

[86] PCT No.: PCT/JP96/01367

§ 371 Date: Nov. 20, 1997

§ 102(e) Date: Nov. 20, 1997

[87] PCT Pub. No.: WO96/37695

PCT Pub. Date: Nov. 28, 1996

[30] Foreign Application Priority Data

May 24, 1995 [JP] Japan ..... 7-149616

[51] Int. Cl.[6] ..... F02D 41/32

[52] U.S. Cl. ..... 123/676

[58] Field of Search ..... 123/676

[56] References Cited

U.S. PATENT DOCUMENTS

| | | | |
|---|---|---|---|
| 4,319,451 | 3/1982 | Tajima et al. | 123/676 |
| 5,602,737 | 2/1997 | Sindano et al. | 123/676 |

FOREIGN PATENT DOCUMENTS

| | | | |
|---|---|---|---|
| 50-148411 | 12/1975 | Japan . | |
| 60-3421 | 1/1985 | Japan | 123/676 |
| 60-43144 | 3/1985 | Japan | 123/676 |
| 61-232353 | 10/1986 | Japan | 123/676 |
| 1-170733 | 7/1989 | Japan . | |
| 1-70733 | 7/1989 | Japan | 123/676 |
| 3-048343 | 1/1991 | Japan . | |
| 3-505115 | 11/1991 | Japan . | |

*Primary Examiner*—Erick R. Solis
*Attorney, Agent, or Firm*—Sidley & Austin

[57] ABSTRACT

The present invention is a method of controlling a fuel injection apparatus for an internal combustion engine, and is capable of preventing the breakage of a component which is exposed to high-temperatures, such as an exhaust manifold. To this end, a first set temperature and a second set temperature, higher than the first set temperature, are set in advance, and a temperature of exhaust gas from an internal combustion engine (1) is detected. The number of occasions at which the temperature of the exhaust gas exceeds the first set temperature and the lengths of time during which the temperature of the exhaust gas has exceeded the second set temperature are totaled respectively, and either when the total number of occasions exceeds a predetermined number of occasions or when the total of the lengths of time exceeds a predetermined length, at least one of the following actions are taken: giving an alarm, reducing a fuel injection rate and changing the injection timing.

20 Claims, 2 Drawing Sheets

METHOD OF CONTROLLING FUEL INJECTION APPARATUS FOR INTERNAL COMBUSTION ENGINES

TECHNICAL FIELD

The present invention relates to a method of controlling a fuel injection apparatus for an internal combustion engine, and particularly to a method of controlling a fuel injection apparatus for an internal combustion engine which prevents the breakage of an exhaust manifold and the like as a result of high-temperatures.

BACKGROUND ART

Conventionally, various kinds of methods of controlling fuel injection apparatuses for internal combustion engines have been proposed. Of these methods, a method of controlling a fuel injection apparatus, by detecting a temperature of the exhaust gas with a temperature sensor, is disclosed in Japanese Patent Application Laid-open No. 3-505115. According to this method, one terminal end of a thermometer extends into an exhaust manifold. A temperature sensor is connected thereto by being embedded in an electronic unit type of a control unit. The control unit converts an extremely weak electric signal from the temperature sensor into a pulse width modulated output signal, and outputs the signal to an electronic fuel injection apparatus. The output signal has a duty cycle, which increases as the temperature of the exhaust gas increases when the increase exceeds a certain level.

The structure described above relates to a control that provides a cooling medium only when there is an actual need for cooling. However, many internal combustion engines, which are used in construction machinery or the like, are often used at full power, and the temperature of the exhaust gas frequently increases. Especially in a location with an atmosphere of high temperature, this tendency becomes more noticeable. The exhaust manifolds of the internal combustion engines used in such a place often break. As a result, the construction machinery is stopped, and the operation is stopped, thereby causing a disadvantage that a great loss occurs due to the delayed completion of the construction or the like.

DISCLOSURE OF THE INVENTION

The present invention is made to eliminate the above-described disadvantages of the conventional art, and its object is to provide an improvement of a method of controlling a fuel injection apparatus for an internal combustion engine that is capable of preventing the breakage of a component exposed to high-temperatures, such as an exhaust manifold, and which gives an alarm in order to keep the operation going.

A method of controlling a fuel injection apparatus for an internal combustion engine relating to the present invention is characterized by including the steps of:

- previously setting a first set temperature and a second set temperature, which is higher than the first set temperature,
- detecting a temperature of the exhaust gas discharged from the internal combustion engine,
- respectively totaling the number of occasions at which the temperature of the exhaust gas exceeds the first set temperature, and the lengths of time during which the temperature of the exhaust gas has exceeded the second set temperature, and
- either when the total number of occasions exceeds a predetermined number of occasions, or when the total of the length of time exceeds a predetermined length, taking at least one of the following actions: giving an alarm, reducing a fuel injection rate, and changing the fuel injection timing.

According to the structure described above, when the number of occasions, at which the temperature of the exhaust gas exceeds the first set temperature, exceeds a predetermined value, or when the total of the lengths of time, during which the temperature of the exhaust gas has exceeded the second set temperature, exceeds a predetermined value, the fuel injection rate is restricted, for example, with an alarm being given; therefore, unexpected breakage of the exhaust manifold or the like, which is caused by high-temperatures of the exhaust gas can be prevented. In addition, after an alarm is given, an operation can be carried out even if the fuel injection rate is restricted; therefore, there is less delay in completion of the construction. The breakage of an exhaust manifold or the like can be also prevented by changing the injection timing.

BEST MODE FOR CARRYING OUT THE INVENTION

A preferred embodiment of a method of controlling a fuel injection apparatus of internal combustion engines according to the present invention will be particularly described below with reference to the attached drawings.

Figure 1:
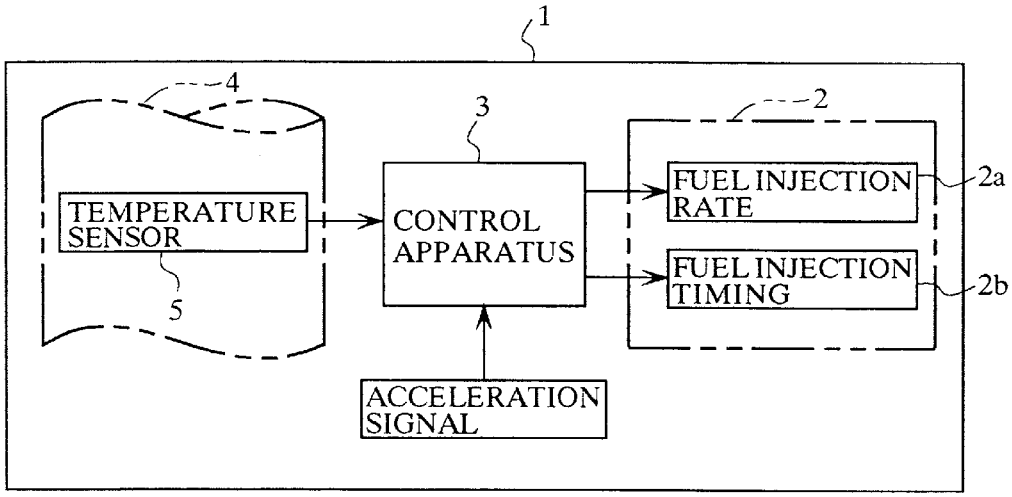
FIG. 1 is a block diagram of an internal combustion engine related to an embodiment of the present invention.

In FIG. 1, a fuel injection apparatus 2 such as an electronic governor, which supplies each cylinder with fuel, is attached to an internal combustion engine 1. The fuel injection apparatus 2 is connected to a control apparatus 3 such as a controller, and receives a command of the fuel injection rate which the internal combustion engine 1 supplies to each cylinder. A temperature sensor 5, which is attached to an exhaust manifold 4 of the internal combustion engine 1, is connected to the control apparatus 3. The temperature sensor 5 measures the temperature of the exhaust manifold 4, and outputs the measured value to the control apparatus 3. The fuel injection apparatus 2 includes an electromagnetic flow control valve 2*a*, which controls the fuel injection rate, and a solenoid valve 2*b*, which regulates the fuel injection timing, and each valve is actuated by a respective command from the control apparatus 3. It should be mentioned that the fuel injection apparatus 2 can include either the valve 2*a* or the valve 2*b*, which is actuated by a command from the control apparatus 3.

Figure 2:
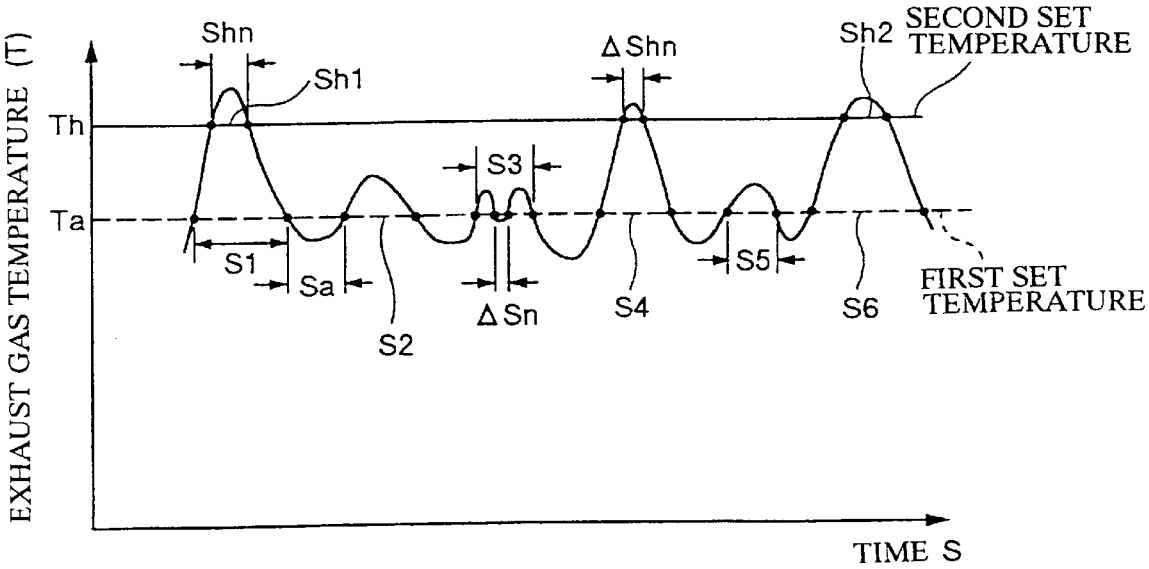
FIG. 2 is a graph which is related to the embodiment, and which explains the relationship between an example of the temperature of the exhaust gas of an engine and the two set temperatures.

The operation of the structure described above will be explained. When an operation is carried out with construction machinery or the like, an operator usually presses the accelerator pedal fully, and an operation is frequently carried out at full power. As a result, the temperature of the exhaust gas rises and changes, for example, as in FIG. 2. In FIG. 2, a temperature T of an exhaust gas is shown by the axis of ordinate, and a time S is shown by the axis of abscissa. For the exhaust gas temperature T, a first set temperature Ta, and a second set temperature Th which is higher than the first set temperature Ta are set. The first set temperature Ta is set at a temperature which causes thermal fatigue, and the second set temperature Th is set at a temperature which causes breakage by oxidation.

As for thermal fatigue, the number of occasions at which the temperature of the exhaust gas exceeds the first set temperature Ta is memorized and recorded. At each occation when the temperature T of the exhaust gas exceeds the first set temperature Ta, then falls to a point less than the first set temperature Ta, and then exceeds the first set temperature Ta once again, the time period during which the temperature is below the first set temperature Ta is measured. When the measured time period does not exceed a predetermined time period Sa, the measured time period is not recorded as one of the number of occasions even if the temperature exceeds the first set temperature Ta once again. A time period which does not exceed the predetermined time period Sa is shown by ΔSn.

As for the breakage by oxidation, the lengths of a time period, during which the temperature has exceeded the second set temperature Th, is memorized in the control device 3 and is recorded. However, the length of a time period, during which the temperature of the exhaust gas has exceeded the second set temperature Th, is recorded only when that length of the time period exceeds the length of a predetermined time period Sh (Shn in FIG. 2, n=1, 2); and when the length of the time period does not exceed the length of the predetermined time period Sh (for example, when the length of the measured time period is ΔShn in FIG. 2), the length of the measured time period is not recorded.

Figure 3:
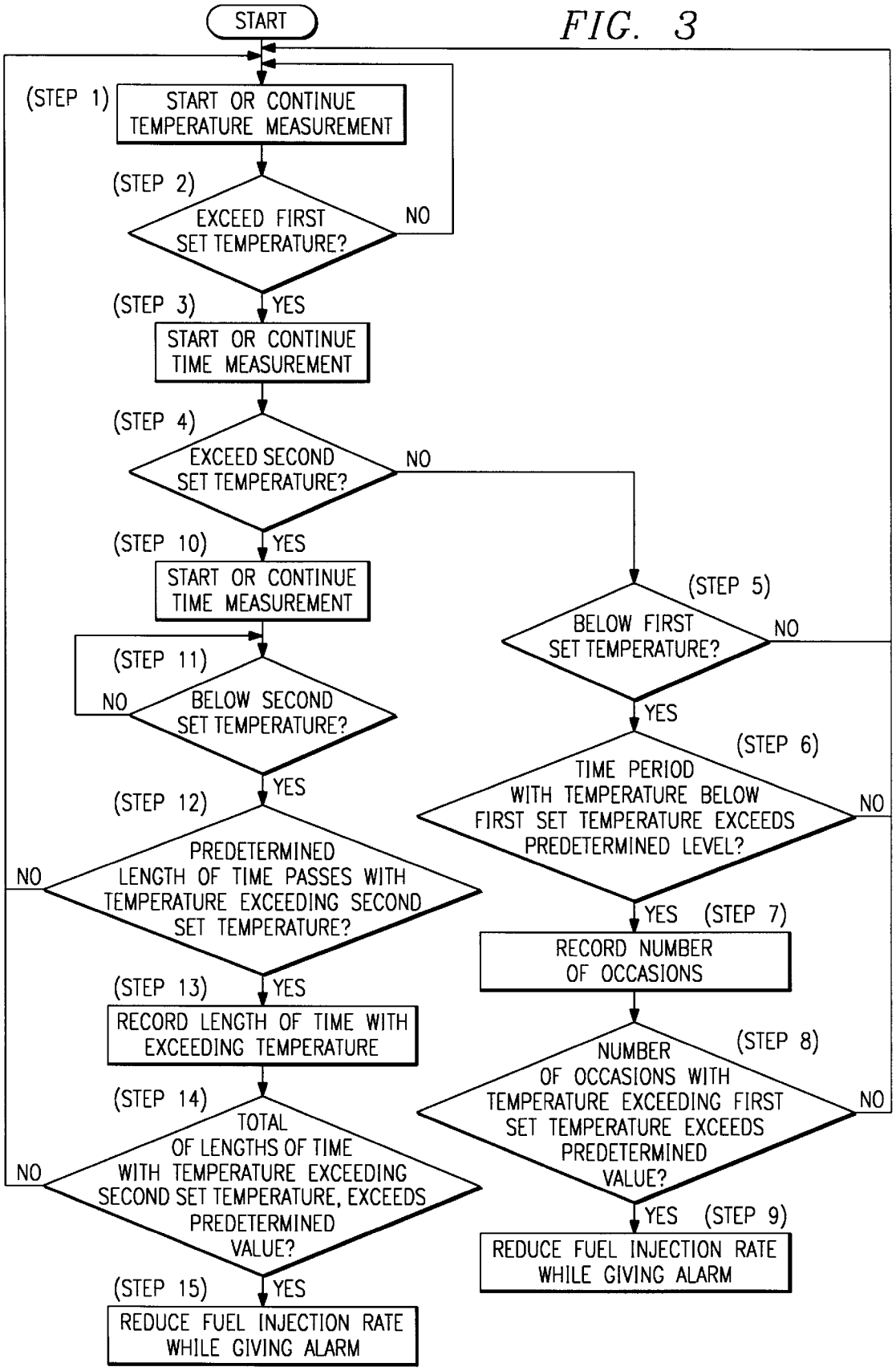
FIG. 3 is a flow chart of the control of a fuel injection apparatus related to the embodiment.

Next, the operation will be explained with reference to the flow chart in FIG. 3.

In Step 1, the temperature T of the exhaust gas is measured by the temperature sensor 5. In Step 2, it is determined whether the temperature T of the exhaust gas exceeds the first set temperature Ta. When the temperature T of the exhaust gas does not exceed the first set temperature Ta, the flow returns to Step 1 and the temperature T of the exhaust gas is measured continuously. On the other hand, when the temperature T of the exhaust gas exceeds the first set temperature Ta, the flow proceeds to Step 3, and the control apparatus 3 starts measuring the time S. Next, the flow proceeds to Step 4, and it is determined whether or not the temperature T of the exhaust gas exceeds the second set temperature Th. When the temperature T of the exhaust gas does not exceed the second set temperature Th, the flow proceeds to Step 5.

In Step 5, it is determined whether the temperature T of the exhaust gas falls below the first set temperature Ta. When the temperature T of the exhaust gas does not fall below the first set temperature Ta, the flow returns to step 1, and the temperature T of the exhaust gas and the length of time are continued to be measured. On the other hand, when the temperature T of the exhaust gas falls below the first set temperature Ta, the flow proceeds to Step 6, and it is determined whether the length of the time period during which the temperature T of the exhaust gas is below the first set temperature Ta exceeds the length of the predetermined time period Sa. When the length of the time period does not exceed the length of the predetermined time period Sa, the flow returns to Step 1 without recording the length of that time period as one of the number of occasions, and the temperature T of the exhaust gas is measured. On the other hand, when the length of the time period exceeds the length of the predetermined time period Sa, the flow proceeds to Step 7, and the length of the time period is recorded as one of the number of occasions to obtain a total number of occasions Sn.

In Step 8, it is determined whether the number of occasions, at which the temperature T of the exhaust gas exceeds the first set temperature Ta, exceeds a predetermined total number of occasions Σ Sn. When the number of occasions exceeds the predetermined total number of occasions Σ Sn, one of the following actions is taken in Step 9: giving an alarm, reducing a fuel injection rate, and changing the injection timing. Incidentally, it is preferable to combine the action of giving an alarm with the action of reducing a fuel injection rate or with the action of changing the injection timing. When the number of occasions does not exceed the predetermined total number of occasions Σ Sn in Step 8, the flow returns to Step 1, and the temperature T of the exhaust gas is measured.

When the temperature T of the exhaust gas exceeds the second set temperature Th in Step 4, the flow proceeds to Step 10, and the control apparatus 3 starts measuring the length of the time period during which the temperature T of the exhaust gas has exceeded the second set temperature Th. Next, the flow proceeds to Step 11, and it is determined whether the temperature T of the exhaust gas falls below the second set temperature Th. When the temperature T of the exhaust gas does not fall below the second set temperature Th, the action in Step 11 is repeated to measure the temperature T of the exhaust gas and to continue to measure the length of the time period. When the temperature T of the exhaust gas falls below the second set temperature Th, the flow proceeds to Step 12, and it is determined whether the length of the measured time period exceeds the length of a predetermined time period Sh. When the length of the measured time period does not exceed the length of the predetermined time period Sh (when the length of the measured time period is ΔShn in FIG. 2), the length of that measured time period is not recorded, and the flow returns to Step 1 to measure the temperature T of the exhaust gas. On the other hand, when the length of measured time period exceeds the length of the predetermined time period Sh, the flow proceeds to Step 13, and the length of that measured time Shn period (n=1, 2 . . . ) is recorded to obtain the total of the recorded lengths of time (Sh1+Sh2 . . . ).

In Step 14, it is determined whether the total of the recorded lengths of time (Sh1+Sh2 . . . ) exceeds a predetermined total length of time Σ Shn. When the total of the recorded lengths of time exceeds the predetermined total length of time Σ Shn, at least one of the following actions is taken in Step 15 as in Step 9: giving an alarm, reducing a fuel injection rate, and changing the fuel injection timing. When the total of the recorded lengths of time does not exceed the predetermined total length of time (Σ Shn) in Step 15, the flow returns to Step 1 to measure the temperature T of the exhaust gas.

INDUSTRIAL AVAILABILITY

The present invention is useful as a method of controlling a fuel injection apparatus for internal combustion engines, which prevents an unexpected breakage of an exhaust manifold or the like, so that the construction machinery is not stopped by a breakdown, since a fuel injection rate is restricted and an alarm is given when the number of occasions at which the temperature of the exhaust gas exceeds a set temperature exceeds a predetermined number of occasions, or when the total length of time during which the temperature of the exhaust gas has exceeded a set temperature exceeds a predetermined length.

We claim:

1. A method of controlling a fuel injection apparatus for an internal combustion engine, wherein said fuel injection apparatus supplies fuel to said internal combustion engine and said internal combustion engine discharges exhaust gas, said method comprising the steps of:

setting a first set temperature;

setting a second set temperature which is higher than said first set temperature;

detecting a temperature of said exhaust gas;

determining an occasion when, after a thus detected temperature of said exhaust gas has exceeded said first set temperature, said thus detected temperature decreases to less than said first set temperature and then after a first period of time increases to again exceed said first set temperature;

totaling a number of thus determined occasions to provide a total number of occasions;

determining a length of time for which said thus detected temperature exceeds said second set temperature; and either when said total number of occasions exceeds a predetermined number of occasions, or when said length of time exceeds a predetermined length, taking at least one of the following actions:

(a) giving an alarm, (b) reducing an injection rate of fuel to said internal combustion engine, and (c) changing an injection timing of fuel to said internal combustion engine.

2. A method in accordance with claim 1, wherein said step of determining an occasion is accomplished only when a length of a respective said first period of time is greater than a first predetermined value.

3. A method in accordance with claim 1, wherein said step of taking at least one of the actions comprises giving said alarm and reducing said injection rate of fuel to said internal combustion engine.

4. A method in accordance with claim 1, wherein said step of taking at least one of the actions comprises giving said alarm and changing said injection timing of fuel to said internal combustion engine.

5. A method in accordance with claim 1, wherein said step of determining a length of time for which said thus detected temperature exceeds said second set temperature comprises:

determining as a second period of time each period of time for which said thus detected temperature exceeds said second set temperature;

determining a length of each thus determined second period of time; and totaling the lengths, of the thus determined second periods of time which exceed a second predetermined value, to provide said length of time for which said thus detected temperature exceeds said second set temperature.

6. A method in accordance with claim 5, wherein said step of taking at least one of the actions comprises giving said alarm and reducing said injection rate of fuel to said internal combustion engine.

7. A method in accordance with claim 5, wherein said step of taking at least one of the actions comprises giving said alarm and changing said injection timing of fuel to said internal combustion engine.

8. A method in accordance with claim 5, wherein said step of determining an occasion is accomplished only when a length of a respective said first period of time is greater than a first predetermined value.

9. A method in accordance with claim 8, wherein said step of taking at least one of the actions comprises giving said alarm and reducing said injection rate of fuel to said internal combustion engine.

10. A method in accordance with claim 8, wherein said step of taking at least one of the actions comprises giving said alarm and changing said injection timing of fuel to said internal combustion engine.

11. Apparatus for controlling a fuel injection device for an internal combustion engine, wherein said fuel injection device supplies fuel to said internal combustion engine and said internal combustion engine discharges exhaust gas, said apparatus comprising:

a controller having an input for setting a first set temperature and for setting a second set temperature, said second set temperature being higher than said first set temperature;

a temperature sensor for detecting a temperature of said exhaust gas and for applying a signal representative thereof to said controller;

said controller determining an occasion when, after a thus detected temperature of said exhaust gas has exceeded said first set temperature, said thus detected temperature decreases to less than said first set temperature and then after a first period of time increases to again exceed said first set temperature;

said controller totaling a number of thus determined occasions to provide a total number of occasions;

said controller determining a length of time for which said thus detected temperature exceeds said second set temperature; and either when said total number of occasions exceeds a predetermined number of occasions, or when said length of time exceeds a predetermined length, said controller taking at least one of the following actions:

(a) giving an alarm, (b) reducing an injection rate of fuel to said internal combustion engine, and (c) changing an injection timing of fuel to said internal combustion engine.

12. Apparatus in accordance with claim 11, wherein said controller determines an occasion only when a length of a respective said first period of time is greater than a first predetermined value.

13. Apparatus in accordance with claim 11, wherein when said controller takes at least one of the actions said controller gives said alarm and reduces said injection rate of fuel to said internal combustion engine.

14. Apparatus in accordance with claim 11, wherein when said controller takes at least one of the actions said controller gives said alarm and changes said injection timing of fuel to said internal combustion engine.

15. Apparatus in accordance with claim 11, wherein said controller determines a length of time for which said thus detected temperature exceeds said second set temperature by determining as a second period of time each period of time for which said thus detected temperature exceeds said second set temperature, by determining a length of each thus determined second period of time, and by totaling the lengths, of the thus determined second periods of time which exceed a second predetermined value, to provide said length of time for which said thus detected temperature exceeds said second set temperature.

16. Apparatus in accordance with claim 15, wherein when said controller takes at least one of the actions said controller gives said alarm and reduces said injection rate of fuel to said internal combustion engine.

17. Apparatus in accordance with claim 15, wherein when said controller takes at least one of the actions said controller gives said alarm and changes said injection timing of fuel to said internal combustion engine.

18. Apparatus in accordance with claim 15, wherein said controller determines an occasion only when a length of a respective said first period of time is greater than a first predetermined value.

19. Apparatus in accordance with claim 18, wherein when said controller takes at least one of the actions said controller gives said alarm and reduces said injection rate of fuel to said internal combustion engine.

20. Apparatus in accordance with claim 18, wherein when said controller takes at least one of the actions said controller gives said alarm and changes said injection timing of fuel to said internal combustion engine.

* * * * *